US007765656B2

(12) United States Patent
Dannenberg

(10) Patent No.: US 7,765,656 B2
(45) Date of Patent: Aug. 3, 2010

(54) APPARATUS AND METHOD FOR GENERATING POST-BURIAL AUDIO COMMUNICATIONS IN A BURIAL CASKET

(76) Inventor: Jeff Dannenberg, 40 Hendricks Isle, Fort Lauderdale, FL (US) 33025

( * ) Notice: Subject to any disclaimer, the term of this patent is extended or adjusted under 35 U.S.C. 154(b) by 0 days.

(21) Appl. No.: 12/430,507

(22) Filed: Apr. 27, 2009

(65) Prior Publication Data

US 2010/0146752 A1 Jun. 17, 2010

Related U.S. Application Data

(63) Continuation-in-part of application No. 12/334,604, filed on Dec. 15, 2008.

(51) Int. Cl.
*A61G 17/00* (2006.01)

(52) U.S. Cl. ..... 27/31; 27/2; 360/12; 369/19

(58) Field of Classification Search ..... 27/31, 27/2, 1; 360/12; 369/19, 69; 40/124.5, 455; 52/103–104
See application file for complete search history.

(56) References Cited

U.S. PATENT DOCUMENTS

| | | | | |
|---|---|---|---|---|
| 1,214,319 | A | 1/1917 | Kennedy et al. | |
| 4,304,076 | A * | 12/1981 | Splendora | 52/104 |
| 4,367,461 | A | 1/1983 | Gauchard | |
| 5,277,452 | A | 1/1994 | Skidmore | |
| 5,404,343 | A | 4/1995 | Boggio | |
| 5,729,921 | A | 3/1998 | Rojas | |
| 5,987,720 | A * | 11/1999 | Yamamoto | 27/35 |
| 6,324,736 | B1 | 12/2001 | Atrio | |
| 6,414,663 | B1 * | 7/2002 | Manross, Jr. | 345/87 |
| 6,980,107 | B1 | 12/2005 | Ziegler | |
| 7,089,495 | B2 | 8/2006 | Barrows | |
| 2001/0036354 | A1 * | 11/2001 | Majors | 386/46 |
| 2003/0208890 | A1 | 11/2003 | Kim | |

* cited by examiner

*Primary Examiner*—William L. Miller
(74) *Attorney, Agent, or Firm*—Mark D. Bowen, Esq.; Malin Haley DiMaggio; Bowen & Lhota, P.A.

(57) ABSTRACT

An apparatus and method for generating post-burial audio communications from surviving family members, friends, and loved ones by adapting a burial casket with an electronic audio communication system that automatically generates post-burial communications in the casket. The burial casket is thus adapted with an audio message system containing electronically stored audio and music files that are automatically played in accordance with a programmed schedule thereby allowing surviving members means for communicating to the deceased for a period of time after burial. An electronic device having a data storage system for storing recorded audio, such as messages from family and friends, music, or any other suitable audio file is provided. A date tracking timer allows for the selective broadcast of audio content automatically in accordance with user programmed and selected scheduling. A battery power source provides electrical power for the system. The present invention thus provides surviving family and friends with a means of automatically communicating messages and sounds to the deceased after burial. The apparatus has a housing that includes a relatively thin projecting peripheral lip sized to fit on the back of a conventional picture frame such that it may be concealed behind a photograph of the deceased when affixed in the casket. A wireless update device is further provided to allow surviving family members the ability to update, revise, and edit, stored audio files and programming after burial.

10 Claims, 11 Drawing Sheets

APPARATUS AND METHOD FOR GENERATING POST-BURIAL AUDIO COMMUNICATIONS IN A BURIAL CASKET

CROSS REFERENCE TO RELATED APPLICATIONS

This application is a continuation-in-part of U.S. patent application Ser. No. 12/334,604, filed on Dec. 15, 2008.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to burial caskets and coffins, and more particularly to an apparatus and method for generating post-burial audio communications in a casket, and more particularly to a burial casket adapted with an audio message system containing electronically stored audio and music files that are automatically played in accordance with a programmed schedule thereby allowing surviving members with a customizable means for communicating to the deceased for a period of time after burial.

2. Description of Related Art

The passing of family members and loved ones is a time of deep sorrow for the surviving family and friends. Surviving members often wish that they could communicate thoughts and messages to the deceased even after burial as a hopeful means of providing comfort a recently lost loved one.

The prior art reveals a number of advancements directed to enhancing the burial and memorial of departed loved ones. For example, U.S. Pat. No. 1,214,319, issued to Kennedy et al., discloses a burial monument adapted for exhibiting pictures of the deceased. U.S. Pat. No. 5,404,343, issued to Boggio, discloses a resting place marker, such as a grave or tombstone, with an audio system that broadcasts an epitaph, music, poems, stories, or voice messages from the deceased to the world or loved ones. Boggio teaches the need to provide a durable system due to the exposure to the elements. U.S. Pat. No. 5,729,921, issued to Rojas, discloses a burial marker and display box for the preservation of memorabilia and/or ashes of the individual. The device may include recorded audio or video so that individuals may actually hear a deceased individual speak. The device is constructed to be air and watertight to resist the onslaught of the elements. U.S. Pat. No. 6,324,736, issued to Atrio, discloses adapting a funeral casket with a video display capable of playing a recording or other message containing visual images at a funeral service to be observed by mourners at the casket. U.S. Pat. No. 6,980,107, issued to Ziegler, discloses an audio visual display system for use at an interment or memorial site to provide information to users about the individual buried at the location. Similarly, U.S. Pat. No. 7,089,495, issued to Barrows, discloses a video enhanced tombstone for communicating audio and visual data related to the deceased from the tombstone to the user.

Finally, Published Patent Application US 2003/0208890, to Kim, discloses a casket link for providing real time multimedia communications between a deceased and bereaved members of a family. The system essentially comprises a wireless communications system and does not provide for automatically generating pre-recorded audio communications to the deceased according to user selected date and time.

The prior art referenced above is largely devoted to communicating images, messages, and video about the deceased to the living. Often times, however, surviving loved ones have a desire to have messages automatically and periodically broadcast to the deceased in the hope of providing some level of spiritual comfort and expressions of love. Accordingly, there remains a need for providing a casket with an electronic system adapted for automatically generating audible output messages directed to the deceased after burial. There further exists a need for such a system capable of playing pre-recorded audio messages selected based on date and/or time.

BRIEF SUMMARY OF THE INVENTION

The present invention overcomes the limitations and disadvantages present in the art by providing an apparatus and method for generating post-burial audio communications in a burial casket (e.g. coffin) by adapting the casket with an audio message system containing electronically stored audio and music files that are automatically played in accordance with a programmed schedule thereby allowing surviving members means for communicating to the deceased for an extended period of time after burial. As used herein the term "casket" shall mean without limitation, a burial casket, funerary box, burial vault or crypt, funerary urn, or other final resting place for a deceased person or pet. An audio message system in accordance with the present invention comprises an electronic device having a data storage system for storing recorded audio files, such as messages from family and friends, music, or any other audio file. A timing mechanism maintains track of the day and date, to allow for the selective broadcast of audio content automatically in accordance with user programmed and selected scheduling. A battery power source provides electrical power for the system. The present invention thus provides survivors with a means of communicating messages and sounds to the deceased after burial. The apparatus has a housing that includes a relatively thin projecting peripheral lip sized to fit on the back of a conventional picture frame, in place of a conventional frame backing, such that it may be concealed behind a photograph of the deceased when affixed in the casket. A wireless update device is further provided to allow surviving family members the ability to update, revise, and edit, stored audio files and programming after burial.

Accordingly, it is an object of the present invention to provide an audio communication system for automatically generating audio messages within a burial casket after burial.

Another object of the present invention is to provide such a system wherein messages may be selectively broadcast in accordance with a user selected schedule. In accordance with these and other objects, which will become apparent herein-after, the instant invention will now be described with particular reference to the accompanying drawings.

DETAILED DESCRIPTION OF THE INVENTION

With reference now to the drawings, FIGS. 1-14 depict a burial casket adapted with an audio message system, generally referenced as 10, in accordance with the present invention.

Figure 1:
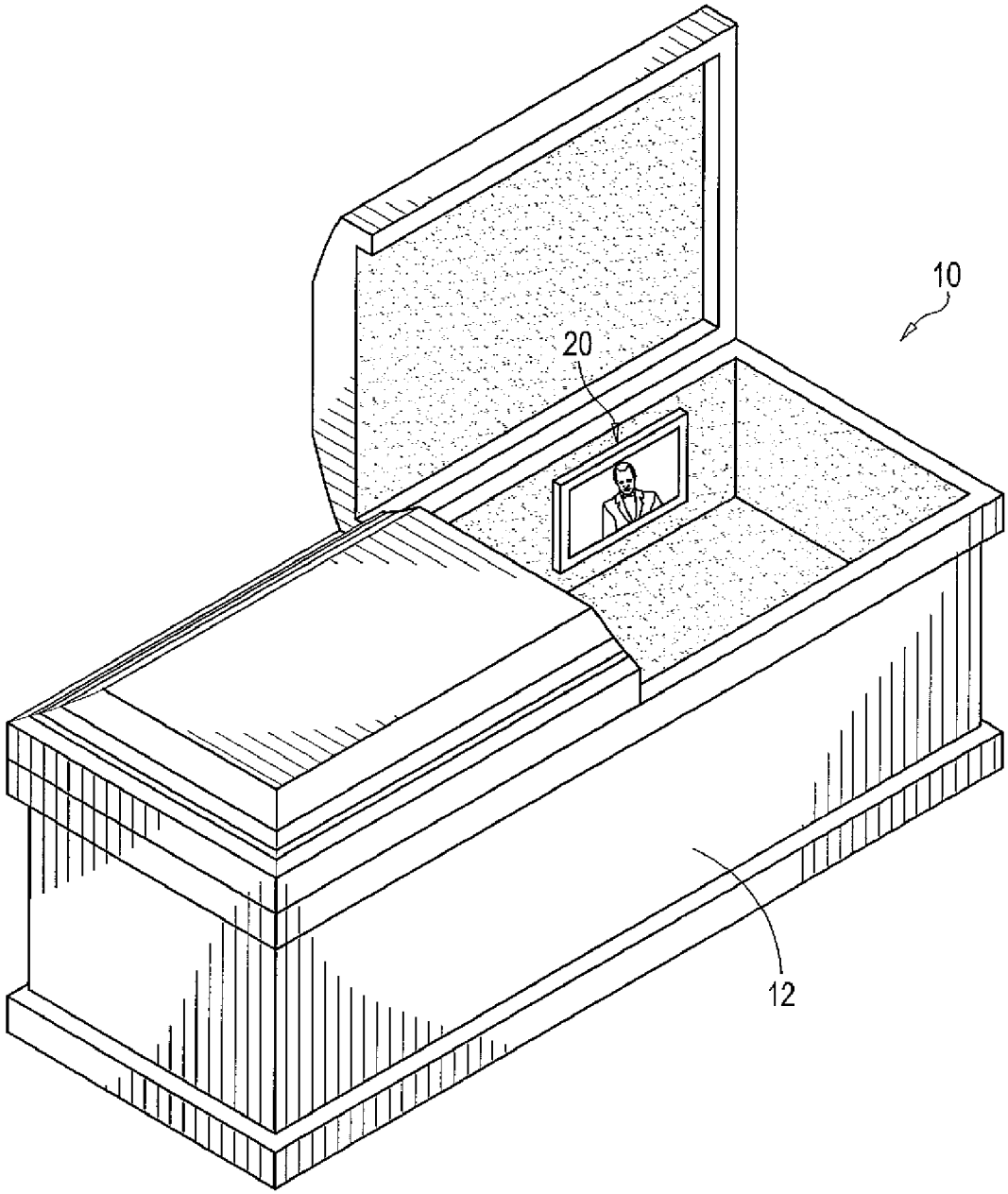
FIGS. 1 and 2 illustrate an audio message system mounted in burial casket for generating post burial messages to the deceased in accordance with the present invention.
Figure 2:
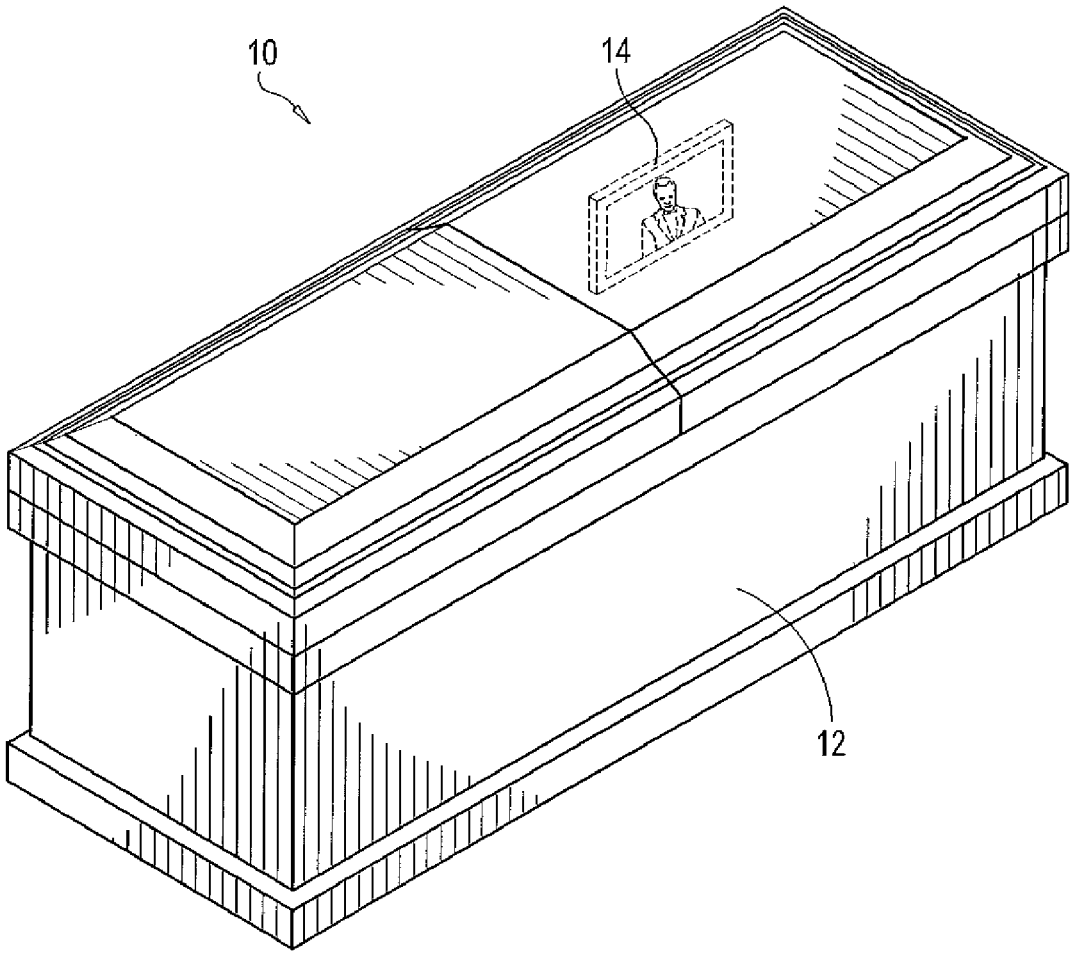

Burial casket audio message system 10 comprises a casket 12 adapted with a casket mountable audio message system 20. Burial casket 12 is preferably a funerary box of the type used in the display and containment of deceased remains, either for burial or cremation. The present invention, however, is suitable for use in a wide variety of applications and environments wherein a deceased person or pet is buried or interned, including a burial casket, funerary box, burial vault or crypt, funerary urn, or other final resting place or memorial site for a deceased person or pet. As illustrated in FIG. 1, 12 includes an electronic audio message system 20 having electronically stored audio and music files that are automatically played in accordance with a programmed schedule thereby allowing surviving members means for communicating to the deceased for a period of time after burial in accordance with the present invention.

Figure 3:
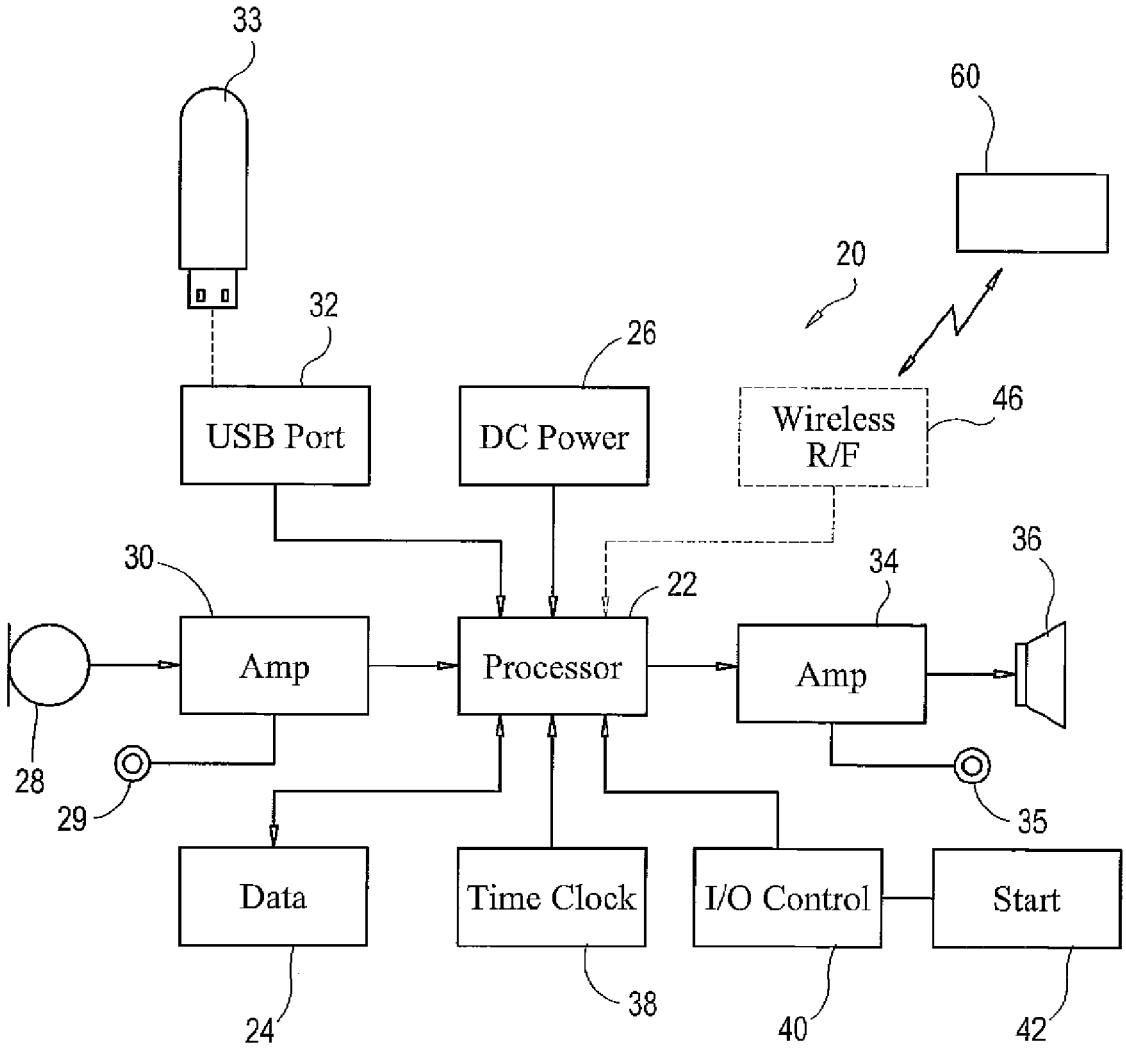
FIG. 3 is an electrical block diagram for an electronic message system of the present invention.
Figure 4:
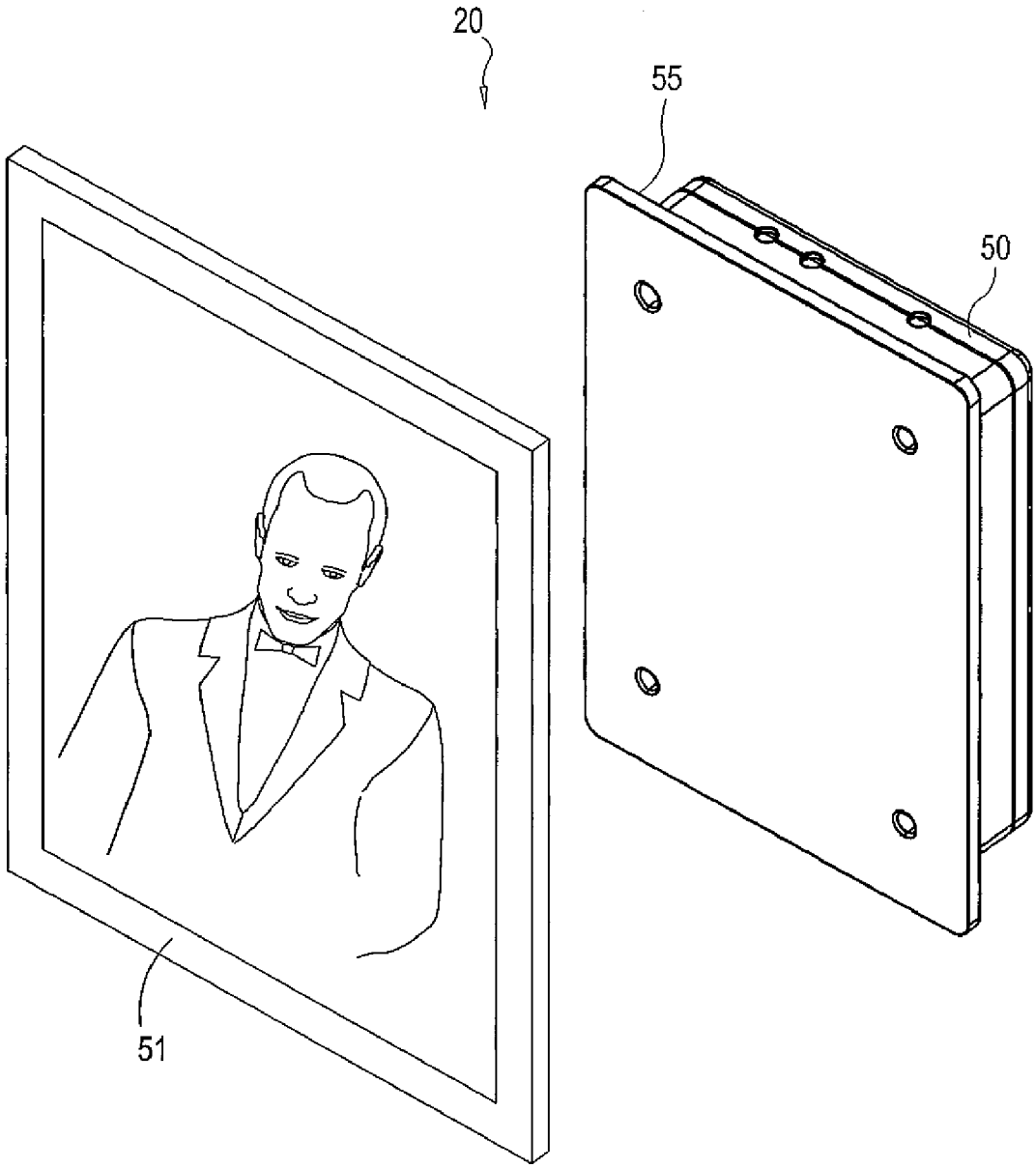
FIG. 4 is an exploded perspective view of an electronic automatic message system in accordance with the present invention illustrating the picture frame mounting feature.
Figure 6:
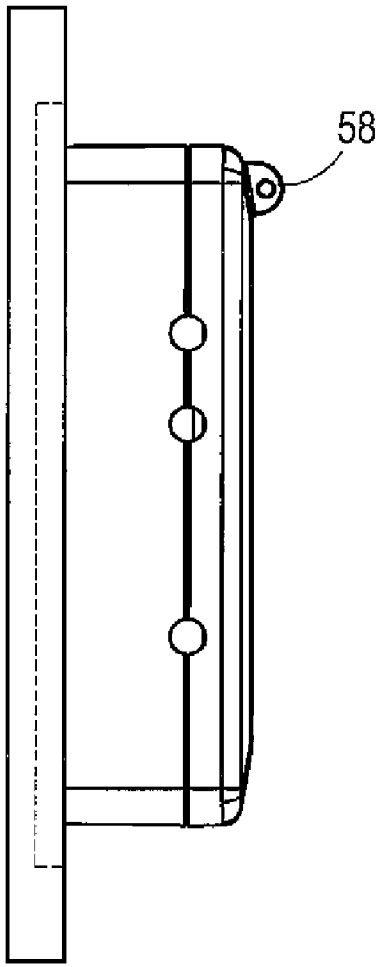
FIG. 6 depicts the electronic message system mounted to the frame.
Figure 5:
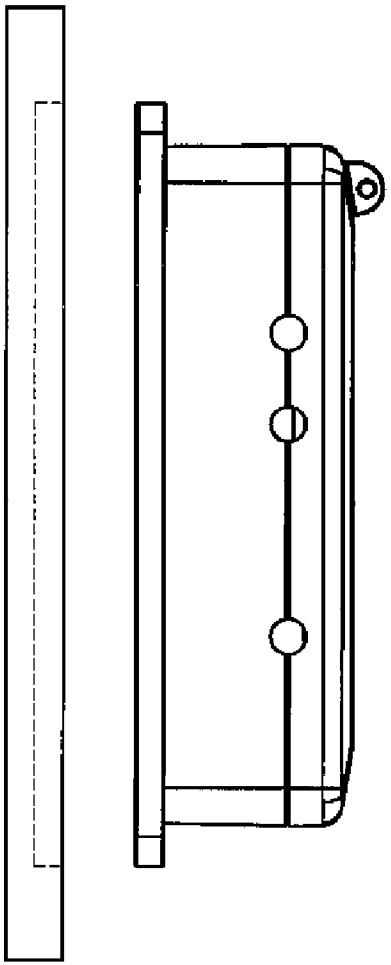
FIG. 5 is a side view thereof.
Figure 7:
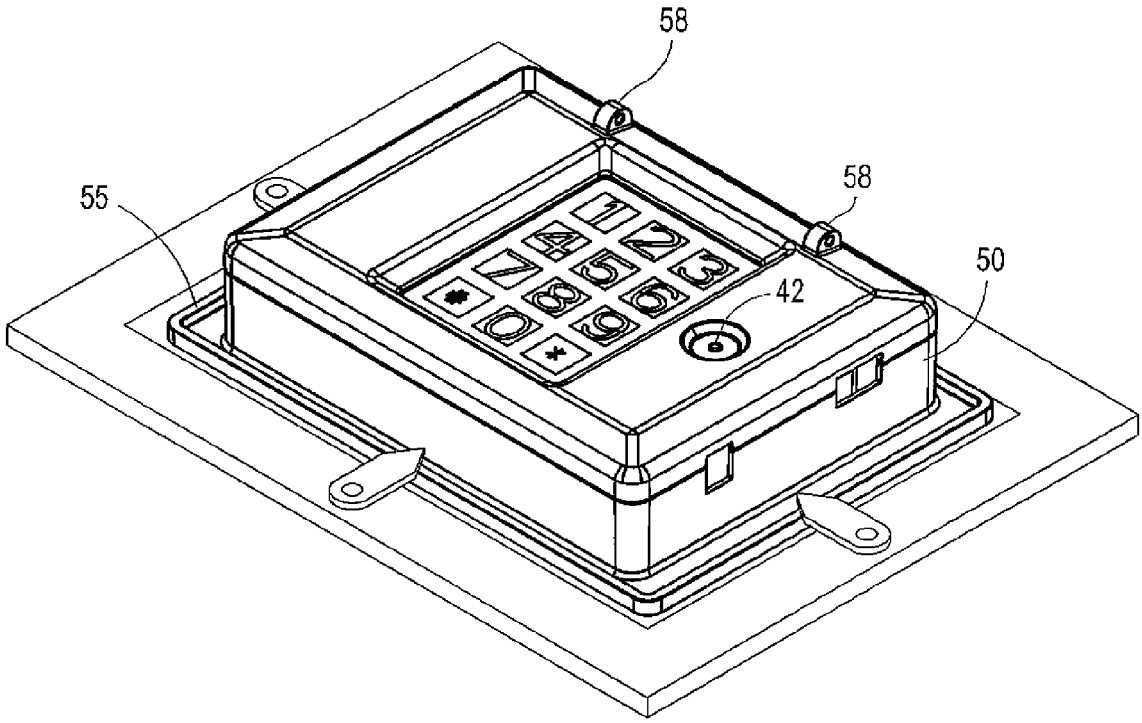
FIG. 7 is rear perspective view showing the electronic message system mounted to the back of the frame.
Figure 8:
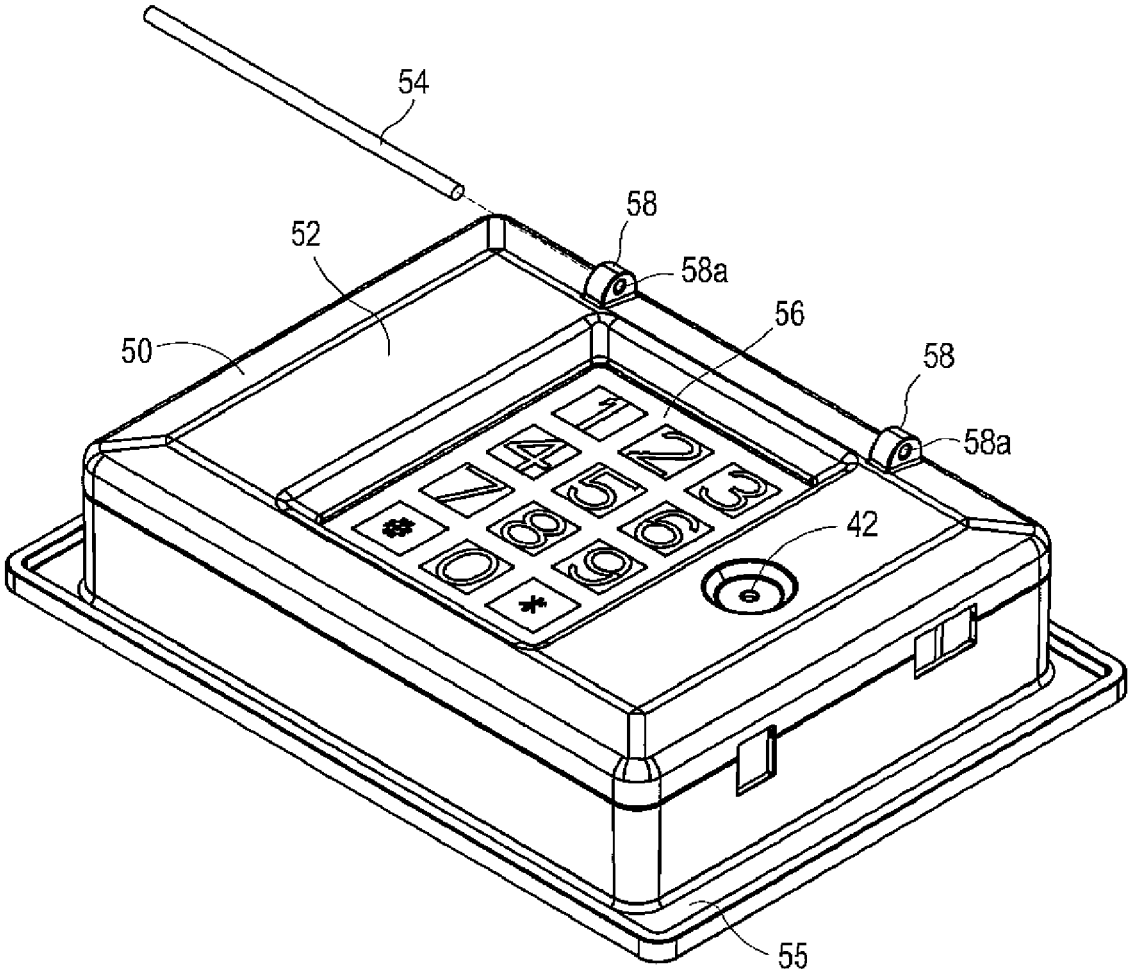
FIG. 8 is a perspective view of the electronic message system showing the mounting pin in exploded relation therwith.
Figure 9:
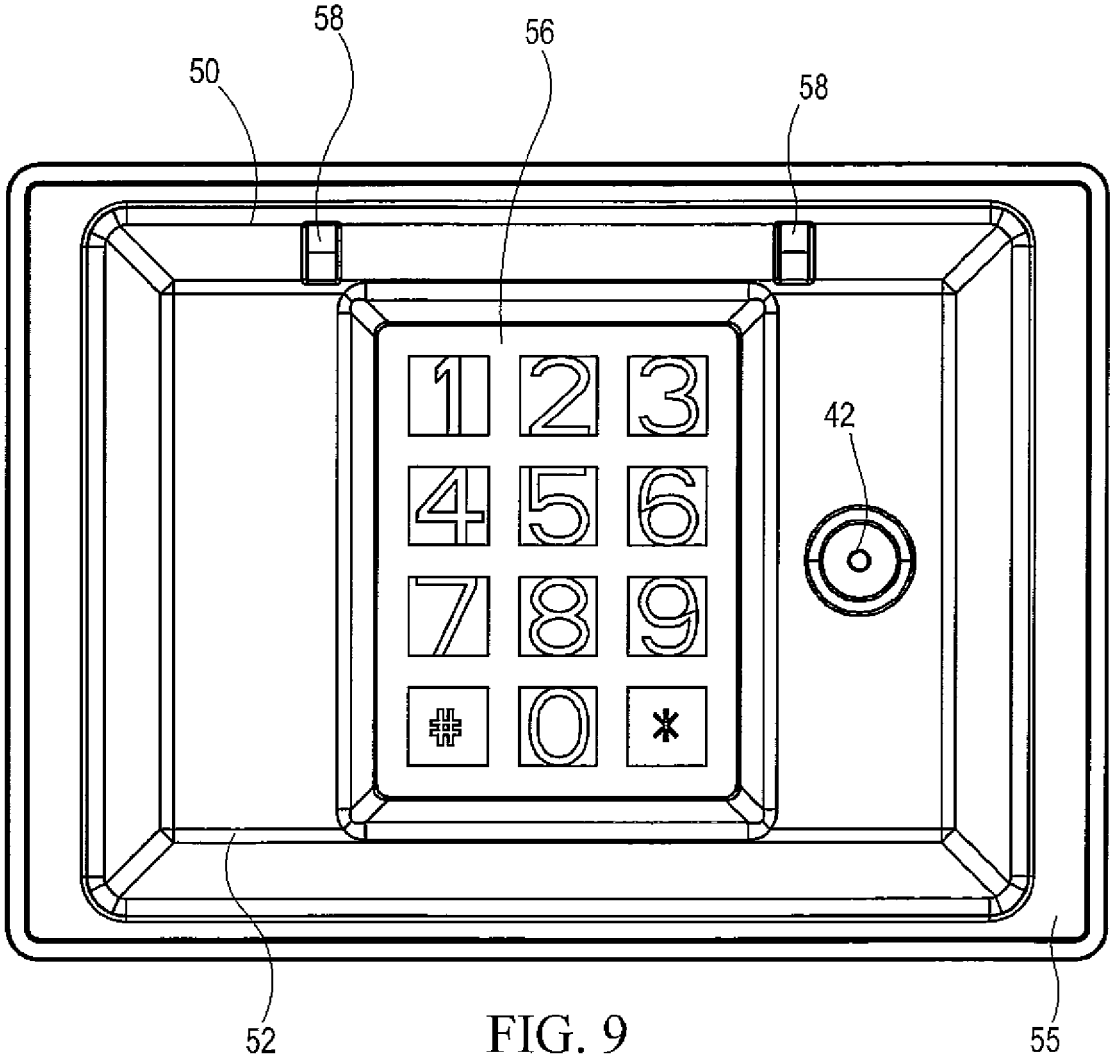
FIG. 9 depicts the input side of the electronic message device.
Figure 10:
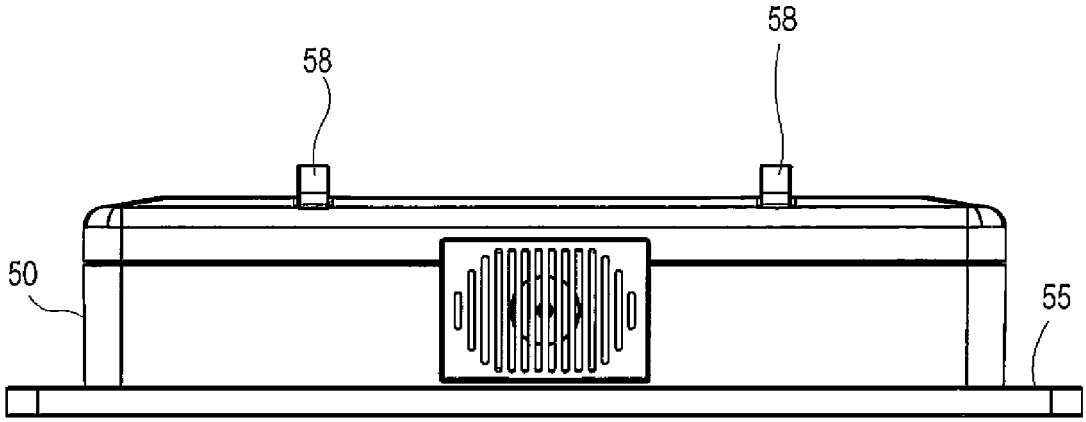
FIG. 10 is a top view thereof.
Figure 11:
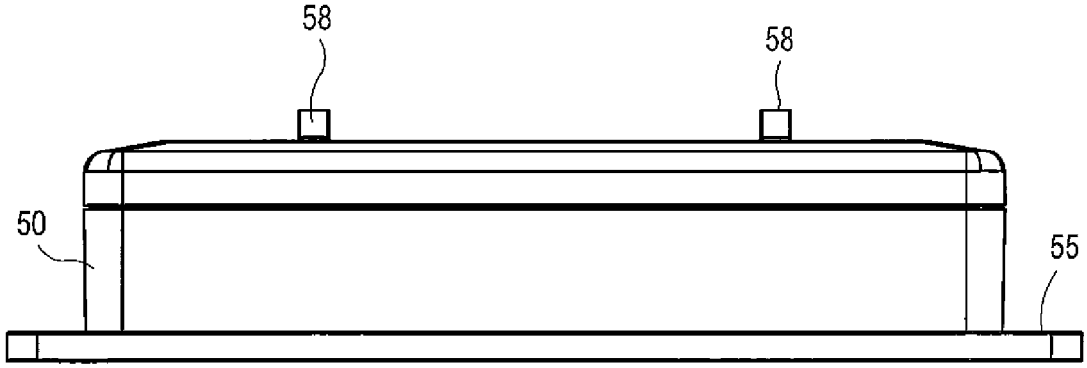
FIG. 11 is a bottom view thereof.
Figure 12:
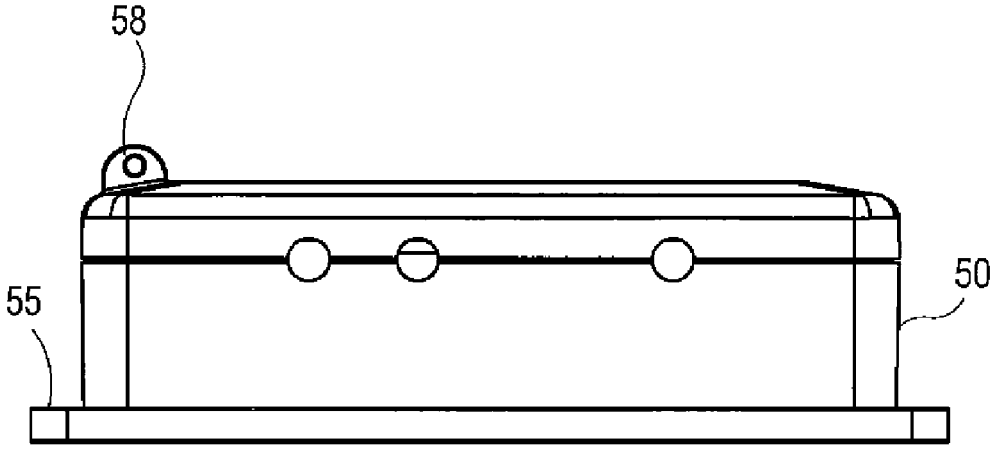
FIG. 12 is a left side view thereof.
Figure 13:
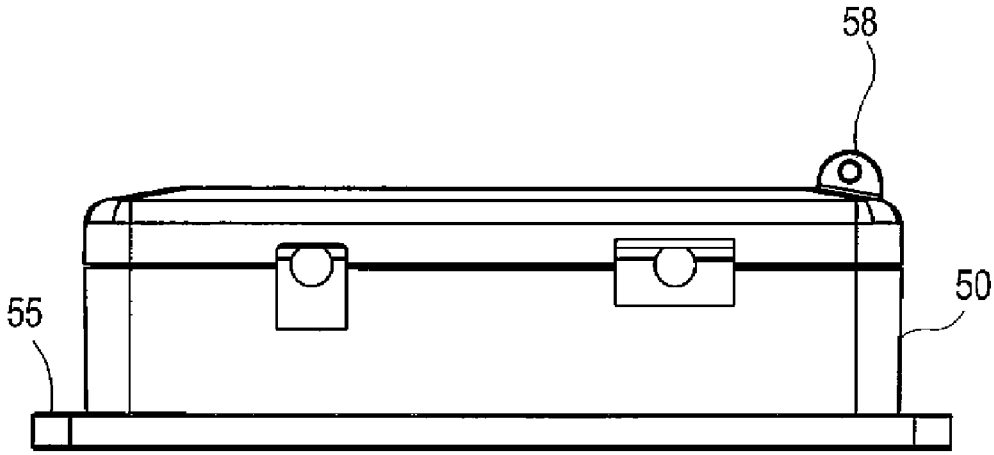
FIG. 13 is a right side view thereof.

Turning now to FIG. 3 there is depicted an electrical schematic block diagram, generally referenced as 20, for an electronic audio message system 14 in accordance with the present invention. The audio message system comprises an electronic system including a processor 22 electronically connected to a data storage device 24. Processor 22 preferably comprises a microprocessor having a central processing unit (CPU) on a computer chip as part of a microcomputing system. Data storage device 24 may comprise any suitable data storage device or memory component or media that retains digital computer data including random access memory (RAM), memory card technology, flash drive, optical drive, or hard drive. Data storage device 24 is capable of storing and retrieving information (i.e. data). A battery 26 is electrically connected for providing electrical power for the system. The battery is intended to provide power for a period of time, preferably having a life span of approximately ten years, depending on the number, length, and frequency of message play. In an alternate embodiment, an above-ground solar panel (not shown) may be provided to charge battery 26.

Audio message system 20 further includes input components to allow for audio and/or music files to be electronically input for storage on data storage device 24. Audio input components preferably include a microphone 28 and amplifier 30 to allow audible messages, sounds, and music to be input for recorded storage in data storage device 24. Microphone 28 may be integral to the unit, or may comprise a separate component that can be removably electrically connected via an integral microphone jack 29. As a result, family and friends of the deceased are able to input messages in their own voices for automatic playback as more fully discussed herein below. In a preferred embodiment, just the microphone jack is provided such that the user can record personal audio messages by speaking into a microphone, rather than merely speaking to plastic housing. In addition, one or more input ports 32 may be provided to allow users to download digital data directly to audio message system 20 using computer hardware, including USB cable link from a computer, USB flash drive, or other suitable data transmission connection between electronic devices. Audio message system 20 further includes output components to allow for audio and/or music files to be electronically output. Audio output components preferably include an audio amplifier 34, an audio output/headphone jack 35, and a speaker 36 in electronic communication with processor 32. As should be apparent amplifier 34 and speaker 36 function to allow the system to generate audio output from recorded information contained in data storage device 24.

Audio message system 20 further includes a digital time clock 38 in electronic communication with processor 22. Digital time clock 38 preferably functions to maintain time, day, and date information. Digital time clock 38 may comprise any suitable real time clock, digital timer, computer timer, or other suitable timing circuit, and preferably maintains at least day and date. In addition, audio message system 14 includes a scheduling input/output controller 40 that allows the system to be adapted to generate audio output based on user specified scheduling parameters. Scheduling input/output ("I/O") controller 40 allows for the system to be programmed to generate selected audio output at predetermined days and/or dates. In a preferred embodiment, messages are replayed in the middle of the day (e.g. noon). I/O controller 40 preferably includes a capacitive sensitive touchpad to allow for input and scheduling using alpha-numeric characters, and a "start" button 42 to initiate a short introduction and menu system.

The system is preferably voice prompted. A "start" button initiates a short audio introduction and pre-recorded voice menu system. The user is prompted, in English, Spanish, or any other language, and makes responsive selections using the touchpad. The menu system allows the user to record new messages and assign a date and time play schedule for each message. The menu system further allows the user to playback recorded audio files and to manage same by erasing or re-recording. In a preferred embodiment, the system utilizes computer processor comprising a 16-bit microcontroller and digital signal controller having voice recording/playback firmware. The firmware enables the encoding, decoding, and compression of speech. Approximately 64 MB of memory is provided to store messages and prompts, including fifteen messages each up to four minutes in length. By way of example, the user, such as a surviving family member (or friend) is allowed to program the system by recording messages and scheduling message playback so that a particular message (e.g. "Happy Birthday John," "Merry Christmas," "Happy Anniversary," etc.) is automatically generated as audio output via speaker 36 on the scheduled date as tracked by time clock 38. As should now be apparent, the present invention allows for surviving family and friends to communicate virtually any message to the deceased based in accordance with programmed scheduling thus providing survivors with a means of communicating messages and sounds to the deceased after burial. As more fully discussed below, system 20 may further include a USB key 33 and wireless radio frequency (RF) module 46 to allow messages to be remotely updated and revised using a remote wireless transmitter.

In accordance with a preferred commercial embodiment illustrated in FIG. 4-13 audio message system 20 comprises a relatively small electronic device having a generally rectangular housing 50 and attachable picture frame 51. Housing 50 includes first or input side 52 and a second or frame mounting side 54. First side 52 includes a capacitive sensitive touchpad 56 to allow for input and scheduling using alpha-numeric characters as discussed above. The first side 52 of housing 50 further includes a pair of projecting flanges, referenced as 58, each of which defines an aperture 58*a*. A removable pin 59 is provided for removable insertion through the aligned apertures defined in flanges 58. Pin 59 functions to allow housing 50 to be removably affixed to the interior cloth/fabric lining of a casket such that the device is secured. The second side 54 of housing 50 includes an outwardly projecting peripheral lip, referenced as 55. Lip 55 is sized and shaped so as to allow for affixation of housing 50 to the back of a conventional picture frame 51, such as a 4×6, 5×7, or 8×10 frame, in place of the conventional backer board typically found on the frame. Accordingly, housing 50 may be received in engagement with a ledge formed at the rear of frame 51 and secured to the back of the picture frame in secured backing relation with a photograph of the deceased. Once secured to the picture frame, the frame and housing assembly may be removably affixed to the interior cloth/fabric lining of a casket such that housing 50 is hidden behind a framed picture of the deceased. Audio message system 14 thus provides a device that can be attached to the back of a conventional picture frame and buried with the deceased.

Remote Update Feature

Figure 14:
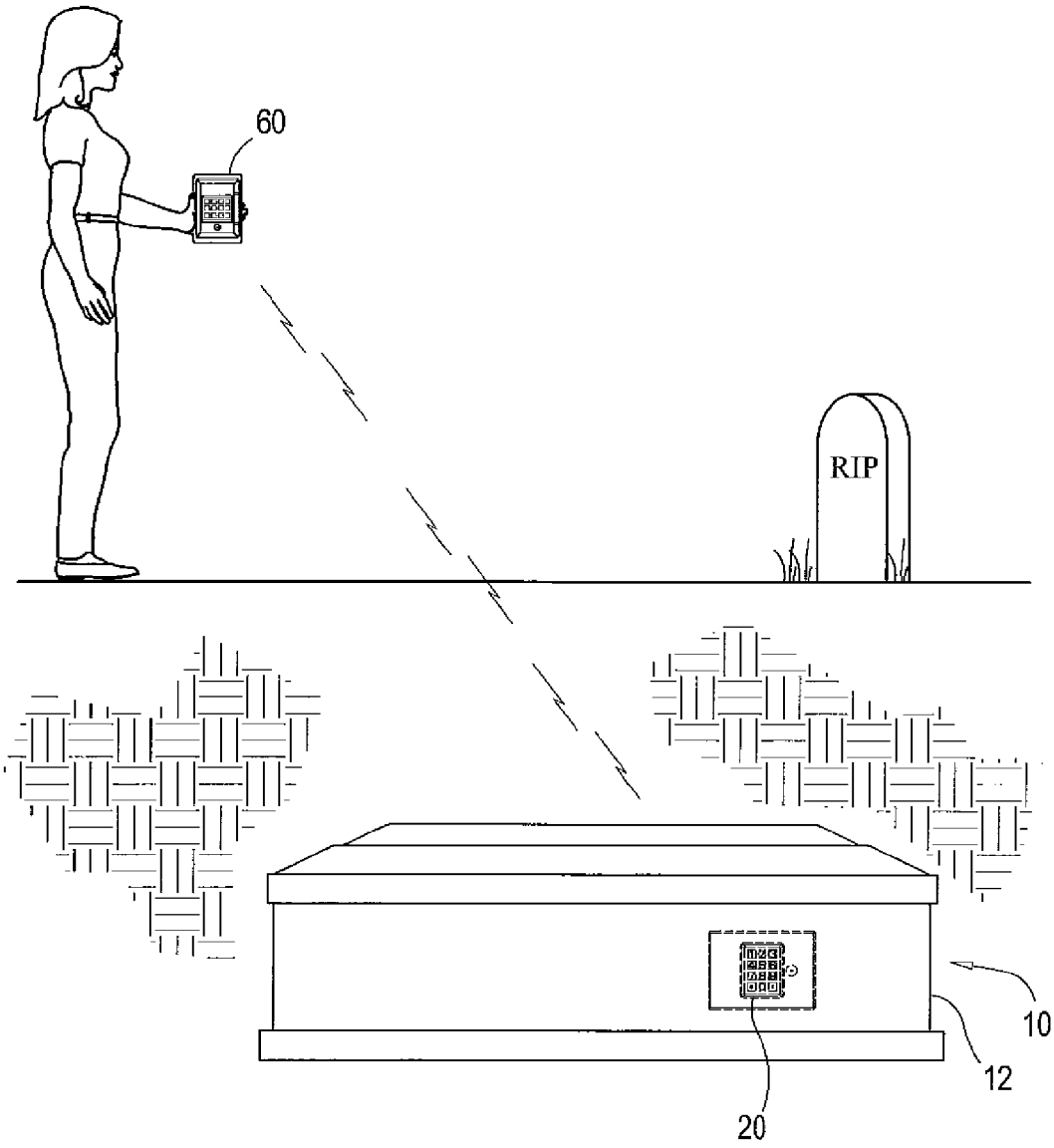
FIG. 14 illustrates updating the messages stored on the electronic message system using a remote wireless update device.

In an alternate embodiment illustrated in FIG. 14, audio message system 20 may further be adapted with wireless communication technology as a wireless receiver, schematically illustrated as 46 in FIG. 3, for receiving wireless remote update communications from a transmitter 60 such that family members and friends are able to change, revise, and edit messages stored in memory. In accordance with this embodiment, a remote update feature is provided by providing primary and secondary audio communication systems, wherein the primary system 20 adapted for wireless communications is mounted in the casket for burial, and the secondary communication system 60 is retained by family members. In a preferred embodiment secondary communication system 60 is a portable electronic device having structural and functional components that are substantially similar to that of primary system 20. The primary and secondary audio communication systems are adapted with wireless communications components and used as functional pairs to provide a remote update feature. In accordance with this embodiment, the primary audio communication system is adapted with a USB key 33 and wireless radio frequency (RF) module 46. The initial start-up and programming of the primary system is as described herein above. Once all the messages have been recorded into the primary communication system, a USB key 33 is inserted into the USB port 32 and all of the messages and audio files stored therein are transferred to the USB key 33. USB key 33 is removed and retained for use with secondary communications system 60 in the possession of surviving family members, friends, or loved ones. By inserting USB key 33 into secondary communication system 60, the surviving members have a complete record of the messages stored on primary system 20 that has been buried in the casket with the deceased. The surviving members may re-record and change any message or all of the messages using the secondary system. Once the messages have been revised and changed, the secondary system is taken to the burial site and activated whereby the updated messages are wirelessly transmitted to the primary system 20 below grade. Each device includes a serial number or other unique identifying marker such that wireless communication is only enabled between primary communication system 20 and its dedicated secondary system. This feature prevents one surviving member from unintentionally updating the memory of other communication systems in proximity to the target system.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An electronic system for automatically generating post-burial audio communications in a burial casket, said system comprising:

an electronic audio device receiving and electronically storing a plurality of audio files;

said device including a time clock for keeping track of date and time;

said device being user programmable such that each of said plurality of audio files is assigned an independent output schedule which is date and time dependent;

said device automatically generating audio output corresponding to said audio files in accordance with respective said independent output schedules;

wherein said audio device is placed in the burial casket to generate post-burial communications in the burial casket.

2. An electronic system for automatically generating post-burial audio communications in a burial casket according to claim 1, where, said electronic audio device includes:

a programmable computer processor;

a data storage device in electrical communication with said computer processor;

said time clock in electrical communication with said computer processor;

means for inputting audio data for storage on said data storage device as said audio files;

means for programming output of selected said audio files from said data storage device in accordance with said independent output schedule;

a speaker in electronic communication with said computer processor;

a battery power source and electrically connected for providing electrical power.

3. An electronic system for automatically generating post-burial audio communications in a burial casket according to claim 1, wherein said electronic device includes a first side having structure for mounting said device to the burial casket.

4. An electronic system for automatically generating post-burial audio communications in a burial casket according to claim 3, wherein said electronic device includes a second side having a peripheral lip, and a picture frame having a back in removable mating engagement with said peripheral lip, whereby said electronic device is concealed behind said picture frame when said device is mounted to the burial casket.

5. An electronic system for automatically generating post-burial audio communications in a burial casket according to claim 1, further including a secondary electronic communication system for remotely changing said audio files and said output schedules via wireless communication link.

6. An electronic audio recording and playback system for automatically generating post-burial audio communications in a burial casket in accordance with an output schedule, said system comprising:

a housing positioned in said burial casket;

said housing containing electrically connected components including: a battery power source, a computer processor, a data storage device, a time clock in electrical communication with said computer processor and for keeping track of date and time, a microphone jack for use with an external microphone, a key pad, an activation button, a speaker, and a voice prompted menu system;

said activation button initiating said voice prompted menu system to generate audio instructions regarding the recording, storage, and scheduling of audio messages;

said audio messages stored on said data storage device as digital audio files;

said computer processor being programmable whereby each of said audio messages is assigned a respective said output schedule such that each of said audio files is generated as audio output in accordance with said respective output schedule which is date and time dependent;

said system functioning to automatically play said post-burial audio communications corresponding to said digital audio files as said audio output from said speaker in accordance with said output schedule.

7. An electronic audio recording and playback system according to claim 6, wherein said housing further includes a peripheral lip, and a picture frame attachable to said peripheral lip whereby said housing is concealed behind said picture frame.

8. An electronic audio recording and playback system according to claim 6, wherein said housing further includes means for removably attaching said housing to the burial casket.

9. An electronic audio recording and playback system according to claim 6, further including means for remotely changing said audio messages stored on said data storage device via wireless communication link.

10. An electronic audio recording and playback system according to claim 9, wherein said means for remotely changing said audio messages stored on said data storage device via said wireless communication link includes said housing further including a wireless communication module, and a secondary portable electronic device including a wireless communication module, said secondary portable electronic device including a back-up copy of said digital audio files, said secondary portable electronic device allowing a user to change any of said audio communications and update said digital audio files on said data storage device via said wireless communication link.

* * * * *